US006314394B1

(12) United States Patent
Finn

(10) Patent No.: US 6,314,394 B1
(45) Date of Patent: Nov. 6, 2001

(54) ADAPTIVE SIGNAL SEPARATION SYSTEM AND METHOD

(75) Inventor: Alan M. Finn, Hebron, CT (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/321,237

(22) Filed: May 27, 1999

(51) Int. Cl.[7] ..... G10L 21/02
(52) U.S. Cl. ..... 704/226; 381/94.2; 704/215
(58) Field of Search ..... 704/219, 220, 704/226, 227, 228, 210, 215; 381/94.1, 94.2, 94.3, 94.7, 94.8

(56) References Cited

U.S. PATENT DOCUMENTS

| | | | | |
|---|---|---|---|---|
| 5,402,520 | * | 3/1995 | Schnitta | 704/226 |
| 5,768,392 | * | 6/1998 | Graupe | 381/94.3 |
| 5,943,429 | * | 8/1999 | Handel | 704/226 |
| 6,014,620 | * | 1/2000 | Handel | 704/219 |
| 6,122,609 | * | 9/2000 | Scalart et al. | 704/226 |

OTHER PUBLICATIONS

M. J. Sousa, "Performance analysis for innovations–based detection," 1992 IEEE International Conference on Acoustics, Speech, and Signal Processing, vol. 5, Mar. 1992, pp. 361 to 364.*

Kay et al., "Extraction of periodic signals in colored noise," 1992 IEEE International Conference on Acoustics, Speech, and Signal Processing, vol. 5, Mar. 1992, pp. 281 to 284.*

S. L. Marple, Jr., "A tutorial overview of modern spectral estimation," 1989 International Conference on Acoustics, Speech, and Signal Processing, vol. 4, May 1989, pp. 2152–2157.*

* cited by examiner

*Primary Examiner*—William Korzuch
*Assistant Examiner*—Martin Lerner
(74) *Attorney, Agent, or Firm*—Brooks & Kushman P.C.

(57) ABSTRACT

A method of reducing undesired components from a signal that includes a desired component and undesirable components utilizes an autoregressive model technique. An autoregressive module determines a power spectral density approximation of the signal. An error component of the power spectral density approximation includes the desired component. Portions of the error component having frequencies outside of the expected range of the desired component preferably are filtered so that the result is the desired component with the undesired component removed. The invention is useful, for example, for reducing undesirable noise components from sound signals.

14 Claims, 1 Drawing Sheet

Fig. 1
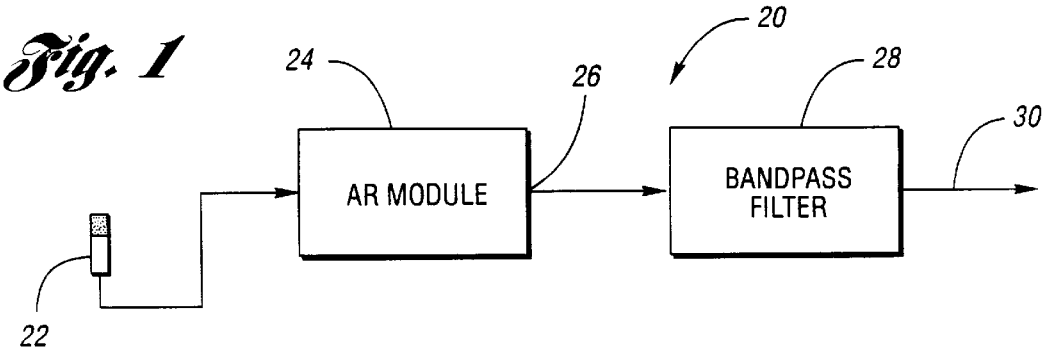
Fig. 2
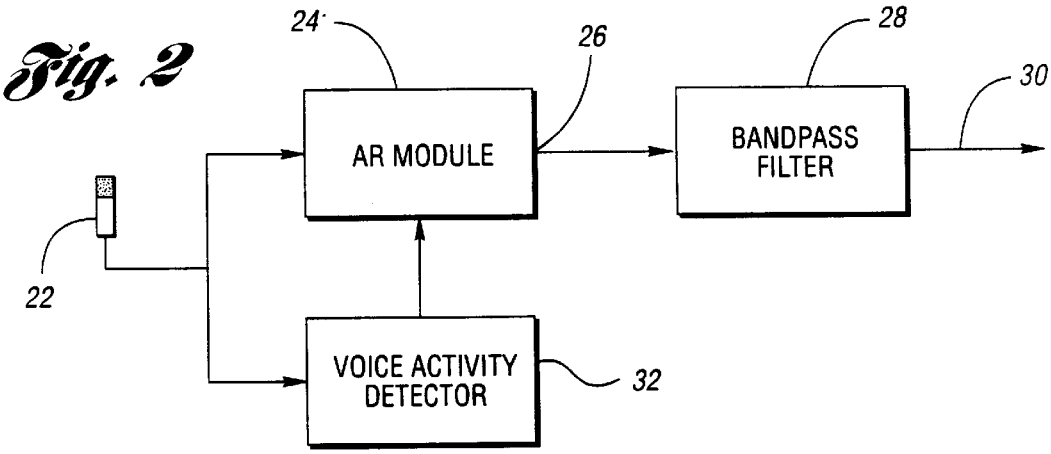
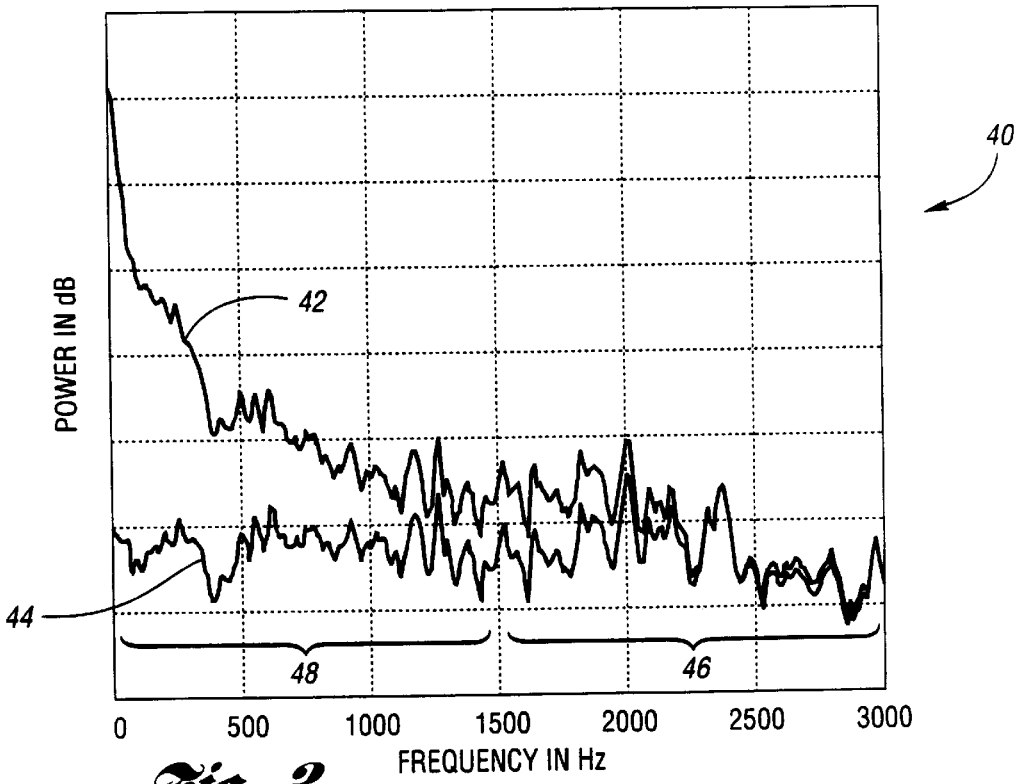
Fig. 3

ADAPTIVE SIGNAL SEPARATION SYSTEM AND METHOD

BACKGROUND OF THE INVENTION

This invention generally relates to a method of reducing an undesired component from a signal having a desired component and an undesired component.

There are a variety of applications where separation of signal components is useful or required. In some situations, an undesired noise component must be filtered out or reduced compared to a desired sound component to achieve understandable transmissions.

One example is when an individual is speaking on a mobile telephone within an automobile. The presence of ambient noise often interferes with the ability of the person whom the individual is speaking with to hear what the individual is saying while driving. This is especially true when one attempts to use a hands-free, speaker phone within a vehicle while driving. The ability to use a speaker phone within a vehicle is desirable because it enhances safe operation so that a driver can keep both hands on the steering wheel and not be distracted from the task of driving the vehicle as much as when the driver must hold onto a cellular telephone, for example. The inability to communicate effectively, however, limits the usefulness of currently available vehicle speaker phones.

There are a variety of other applications where ambient noise is also detected by a microphone, which interferes with the projection of the desired speech component. Other applications where ease, clarity and accuracy of communication of speech is necessary include voice recognition systems, voice control systems and cabin communication systems.

With the wide variety of applications for noise reduction systems, it is not surprising that several attempts have been made to fulfill this need. One example of a noise reduction method is sometimes referred to as "spectral subtraction." This approach typically works in the frequency domain and depends upon separating speech, which typically has non-stationary statistics, from noise, which typically has stationary statistics.

While spectral subtraction methods may be useful, they are not without shortcomings or drawbacks. For example, the noise reduction provided by such methods may include musical artifacts in the reproduced speech. Additionally, there typically is a requirement for voice activity detectors in the equipment utilized to perform the method. Moreover, the spectral subtraction methods require considerable computation for Fast Fourier Transforms and may exhibit processing delays that affect the quality of the reduced speech. The large amount of computation time not only affects the quality of the reproduced speech but also can impose relatively high costs on a noise reduction system. In many applications, such as the hands-free cellular telephone within a vehicle mentioned above, the expenses associated with providing sufficient computational capability and computer memory to accomplish a spectral subtraction method typically render it not practical for such an application.

There is a need for a more efficient, more effective and more economical signal separation method that can have wide application. This invention provides such a method and avoids the shortcomings and drawbacks described above.

SUMMARY OF THE INVENTION

In general terms, this invention is a method of reducing an undesirable component from a signal that contains a desired component such as speech. The method of this invention includes several basic steps. First, a signal having a desired component and an undesirable component is captured. A power spectral density approximation of the captured signal is then made and an error component is separated out from that approximation. The desired component is then determined from the error component of the power spectral density approximation.

In the preferred embodiment, the error component of the power spectral density approximation is filtered to separate out portions having a frequency above a preselected maximum. For example, where the desired component is speech, any sound components having a frequency that exceeds the typical high end frequency of human speech (e.g., 1500 Hz) are filtered out using a bandpass filter, for example.

A system designed according to this invention preferably includes a collector, such as a microphone, that collects signals or vibrations that include a desired component. The collector generates a signal indicative of the collected signals. An autoregressive module is in communication with the collector and receives the signal from the collector. The autoregressive module determines a power spectral density approximation, which includes an error component, of the signal from the collector. A filter module filters the error component to remove portions of the error component that have a frequency above a preselected maximum such that the filtered error component includes a reduced amount of undesired components and the desired component is more clearly discernable.

The various features and advantages of this invention will become apparent to those skilled in the art from the following detailed description of the currently preferred embodiments. The drawings that accompany the detailed description can be briefly described as follows.

BRIEF DESCRIPTION OF THE DRAWINGS

FIG. 1 schematically illustrates a system designed according to this invention.

FIG. 2 schematically illustrates an alternative embodiment of a system designed according to this invention.

FIG. 3 graphically illustrates the results of a portion of the method of this invention.

DETAILED DESCRIPTION OF THE PREFERRED EMBODIMENT

FIG. 1 schematically illustrates a system 20 for reducing the amount of undesirable signal components such as noise within an audible sound signal. Noise is used throughout this description as an example of an undesirable component. The invention, however, is not limited to reducing noise from an audible signal. A collector 22, such as a conventional microphone, collects audible sounds. Since there is almost always some background noise, the collector 22 collects the desired sound component, such as an individual's speech and an undesirable noise component, such as background noise.

The collector 22 generates an electrical signal that is indicative of the collected sounds. An autoregressive module 24 processes the signal provided by the collector 22. The autoregressive module preferably is a software module within a microprocessor or computer.

Autoregressive modeling of signals is known in the art and described, for example, in S. Lawrence Marple, Jr., *Digital Spectral Analysis With Applications,* Prentice Hall, Englewood Cliffs, N.J., 1987; and Steven M. Kay, *Modern*

*Spectral Estimation,* Prentice Hall, Englewood Cliffs, N.J., 1988. Therefore, autoregressive modeling will not be described further in this specification.

The autoregressive module preferably determines a low-order, all-pole approximation of the power spectral density of the signal from the collector 22. An autoregressive modeling technique always includes an error component, as understood by those skilled in the art.

The error component typically has a white (i.e., Gaussian) spectrum. Given the nature of speech, the speech component of the collected signal is found within the error component of the power spectral density approximation provided at the output 26 of the autoregressive module 24. The error component preferably is filtered using a filter module 28 to remove the portions of the error component that have frequencies outside of a preselected range. For example, when the desired sound component includes human speech, the portions of the error component having a frequency over a selected limit (e.g., 1500 Hz) preferably are filtered out by the filter module 28. Under these conditions, the speech component, which would be in the range from 300 Hz to 1500 Hz, is what is output at 30 after the error component is filtered by the filter module 28.

Another preferred embodiment is illustrated in FIG. 2. This embodiment includes the same components as those described above and illustrated in FIG. 1. Additionally, the embodiment of FIG. 2 includes a voice activity detector module 32. In this embodiment, the autoregressive process preferably is adapted only during speech pauses as determined by the voice activity detector module 32. Alternatively, the autoregressive module 24 includes programming such that it is responsive to the voice activity detector module 32 only when the time variation of the noise of the collected signal is sufficiently long that a low rate, continuous adaptation of the autoregressive modeling may be performed.

FIG. 3 includes a graphical illustration 40 of example results of utilizing the method of this invention. The plot 42 represents a collected signal that includes a desired sound component, such as speech, and the undesirable noise component. The plot at 44 represents the error component of the power spectral density approximation provided by the autoregressive module 24. The error component 44 includes the desired sound component and some undesirable noise. In the example where the desired sound component includes an individual's speech, the filter module 28 preferably removes the portion of the signal 44 illustrated at 46. By filtering out all components having a frequency above the selected limit (e.g., 1500 Hz), the components that are outside of the normal speech range are removed and the resulting portion illustrated at 48 contains the desired sound component. As can be appreciated from the drawing, the portion 48 of the signal shown at 44 has much less noise and distortion than the signal shown at 42.

In the preferred embodiment, the autoregressive module 24, the filter module 28 and the voice activity detector module 32 preferably are all implemented using software. Alternatively, hardware components may be utilized to realize one or more of the modules, depending on the needs of a particular situation. Given this description, those skilled in the art will be able to select appropriate components or to write the computer code needed for their particular circumstances.

The filter module 28 preferably operates as a bandpass filter or low pass filter that filters out the portions of the error component resulting from the power spectral density approximation that have a frequency outside of the expected range of the desired sound component. In applications where the embodiment of FIG. 1 is utilized, the autoregressive modeling preferably is continuously adapted at a low rate. When the embodiment of FIG. 2 is implemented, the autoregressive process preferably is adapted only during speech pauses as detected by the voice activity detector module 32.

This invention provides a significant advantage over prior attempts at removing undesirable noise from signals containing desired sound components because the computational requirements are much lower. The spectral subtraction methods, for example, require n $\log_2(n)$ operations, where n typically is 128 or 256. This amount of computation not only introduces delays that impair the quality of the reproduced speech but also imposes computational and computer memory requirements that render such methods impractical for many situations. The method of this invention, on the other hand, typically only requires k operations, where k is the number of autoregressive coefficients, which typically can be within the range from 3 to 7. The lower computational requirements of this invention eliminates the unpleasant time delay in the filtered speech signal. Additionally, the lower computational requirements render the method of this invention more readily implemented within a microprocessor's memory, for example.

Another advantage of this invention is that it automatically tracks and eliminates tone interferences in an original microphone signal by moving a pair of poles to the frequency and phase of the tone. This characteristic is especially useful when the ambient noise contains discrete tones and harmonics as are typically found in moving vehicles. Therefore, this invention is especially useful for reducing undesirable noise from a signal provided by a cellular telephone utilized in a vehicle. This invention makes using hands-free, speaker phone cellular communications from within vehicles much more effective.

As noted above, this invention is not limited to noise reduction. Other systems requiring signal separation would benefit from the invention. For example, an accelerometer that picks up a vibration signal might also pick up undesired vibrations, which result in undesired signal components. Those skilled in the art will realize that this invention is useful for a variety of situations.

The description just given provides example implementations of this invention consistent with the currently preferred embodiments. Variations and modifications may become apparent to those skilled in the art that do not necessarily depart from the purview and spirit of this invention. The scope of legal protection given to this invention can only be determined by studying the following claims

What is claimed is:

1. A method of removing an undesirable component from a signal also containing a desired component, comprising the steps of:

(a) capturing a signal having a desired component and an undesirable component;

(b) determining a power spectral density approximation of the captured signal;

(c) separating an error component out from the power spectral density approximation of step (b); and (d) determining the desired component from the error component of step (c), wherein step (d) includes filtering the error component of step (c) to remove undesirable components having a frequency that exceeds a preselected maximum from the error component.

2. The method of claim 1, wherein step (b) is performed using an adaptive autoregressive modeling process.

3. The method of claim 1, wherein the portion of the error component that is not filtered comprises the desired component.

4. The method of claim 1, wherein step (d) is performed using a bandpass filter.

5. The method of claim 1, wherein steps (b) through (d) are performed by software.

6. The method of claim 1, wherein the desired sound component comprises the sound of an individual speaking and the method further comprises performing step (b) responsive to pauses in the individual's speaking.

7. A system for distinguishing between undesirable and desired signal components, comprising:

a collector that collects signals that include a desired component and an undesirable component and generates a signal indicative of the collected signals;

an autoregressive module in communication with the collector that receives the generated signal from the collector and determines a power spectral density approximation of the generated signal, which includes an error component; and a filter module in communication with the autoregressive module that filters the error component to remove portions of the error component having a frequency above a preselected maximum such that the filtered error component includes the desired component.

8. The system of claim 7, wherein the autoregressive module and the filter module comprise software.

9. The system of claim 7, wherein the desired sound component comprises the sound of an individual voice.

10. The system of claim 9, further comprising a voice activity detector module in communication with the autoregressive module and wherein the autoregressive module is responsive to pauses in the individual voice pattern.

11. The system of claim 10, wherein the autoregressive module, the filter module and the voice activity detector module comprise software.

12. The system of claim 7, wherein the filter module comprises a bandpass filter.

13. The system of claim 7, wherein the autoregressive module comprises a microprocessor.

14. The system of claim 7, wherein the collector comprises a microphone.

* * * * *